United States Patent [19]

Hasegawa

[11] Patent Number: 4,579,445

[45] Date of Patent: Apr. 1, 1986

[54] COPIER HAVING UNIFORM SHEET SIZE MODE

[75] Inventor: Yutaka Hasegawa, Tokyo, Japan

[73] Assignee: Ricoh Company, Ltd., Tokyo, Japan

[21] Appl. No.: 577,400

[22] Filed: Feb. 6, 1984

[30] Foreign Application Priority Data

Feb. 8, 1983 [JP] Japan ..... 58-18219
Feb. 8, 1983 [JP] Japan ..... 58-18220

[51] Int. Cl.[4] ..... G03G 21/00
[52] U.S. Cl. ..... 355/14 R; 355/3 R
[58] Field of Search ..... 355/3 R, 14 R, 7, 8

[56] References Cited

U.S. PATENT DOCUMENTS 3,689,143 9/1972 Case et al. ..... 355/3 R
4,277,163 7/1981 Ikesue et al. ..... 355/14 R
4,505,579 3/1985 Furuichi ..... 355/14 R X

*Primary Examiner*—Fred L. Braun
*Attorney, Agent, or Firm*—David G. Alexander

[57] ABSTRACT

A control device for a copier varies a magnification such that images on different sizes of documents are accommodated in a single predetermined size of copy sheets. The control device includes a read only memory for storing magnification data which are optimum for various combinations of a document size, a copy sheet size and a document orientation, a proper magnification check flag indicative of whether a selected magnification is proper and a document orientation check flag indicative of whether a selected orientation of a document is proper.

7 Claims, 11 Drawing Figures

COPIER HAVING UNIFORM SHEET SIZE MODE

BACKGROUND OF THE INVENTION

The present invention relates to a copier having a uniform sheet size mode of operation in which images on documents having different sizes may be commonly accommodated in copy sheets having a single size.

Some modern copiers are furnished with a uniform sheet size mode which allows images on documents of various sizes such as A3, B4 and A4 to be fully confined in copy sheets of a single size by varying the magnification. With such a copier, one can uniformalize produced copies in size to promote easy filing and can copy images on documents of various sizes even if only a single size of sheets are available.

A problem encountered with a copier of the type described is that even when the size of copy sheets is excessively large or small compared to a document, a copying process is performed without any particular processing against such a sheet size, resulting in excessively small images on copy sheets or substantial blank areas. Another drawback is that even if a document is oriented differently from copy sheets, the copying process is performed without taking it into account, causing an image on the document to be partly missed out on a copy sheet.

SUMMARY OF THE INVENTION

It is therefore an object of the present invention to provide a copier having a uniform sheet size mode which eliminates the drawbacks discussed above.

It is another object of the present invention to provide a copier having a uniform sheet size mode which in a uniform sheet size mode of operation sets up an optimum magnification to surely accommodate an image on a document in a copy sheet of a certain size, thereby producing adequate copies.

It is another object of the present invention to provide a generally improved copier having a uniform sheet size mode.

A control device for a copier which is operable in a uniform sheet size mode to copy pictures on documents having different sizes in sheets having a predetermined single size by varying a magnification by means of a magnification mechanism of an optical system of the present invention comprises a copy sheet size detector for detecting a size of copy sheets, a document size detector for detecting a size of a document, a store for storing magnification data which are optimum for various combinations of a size of a document, a size of copy sheets and an orientation of a document, and a controller for causing the magnification mechanism to set a magnification and controlling a predetermined copying process in response to a copy sheet size detected by the copy sheet size detector and a document size detected by the document size detector.

In accordance with the present invention, a control device for a copier varies a magnification such that images on different sizes of documents are accommodated in a single predetermined size of copy sheets. The control device includes a read only memory for storing magnification data which are optimum for various combinations of a document size, a copy sheet size and a document orientation, a proper magnification check flag indicative of whether a selected magnification is proper, and a document orientation check flag indicative of whether a selected orientation of a document is proper.

The above and other objects, features and advantages of the present invention will become more apparent from the following detailed description taken with the accompanying drawing.

BRIEF DESCRIPTION OF THE DRAWING

FIG. 6 is a diagram illustrating how FIG. 7 is a diagram illustrating how

DESCRIPTION OF THE PREFERRED EMBODIMENT

While the copier having a uniform sheet size mode of the present invention is susceptible of numerous physical embodiments, depending upon the environment and requirements of use, a substantial number of the herein shown and described embodiment have been made, tested and used, and all have performed in an eminently satisfactory manner.

Figure 1:
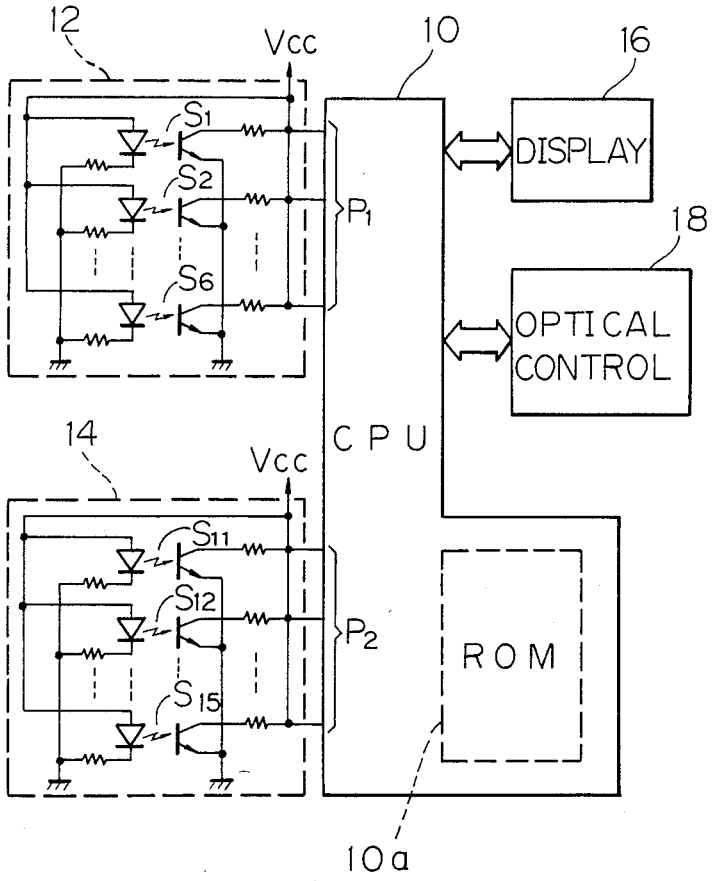
FIG. 1 is a block diagram of a control section included in a copier having a uniform sheet size mode in accordance with the present invention.

Referring to FIG. 1 of the drawing, a control section of a copier in accordance with the present invention is shown. The control section includes a central processing unit (CPU) 10 which performs controls as will be described. A read only memory (ROM) 10*a* stores control programs for the CPU 10, a magnification table which will be described, etc. A document size detecting section 12 comprises a plurality of reflection type photosensors mounted on a presser plate which is adapted to press a document against an optical scanning surface. A sheet size detecting section 14 detects a sheet size which is represented by positions and number of lugs which extend from a sheet cassette. Also shown in FIG. 1 are a display section 16 which will be described, and an optics control section 18 for controlling the magnification and the like.

Figure 2:
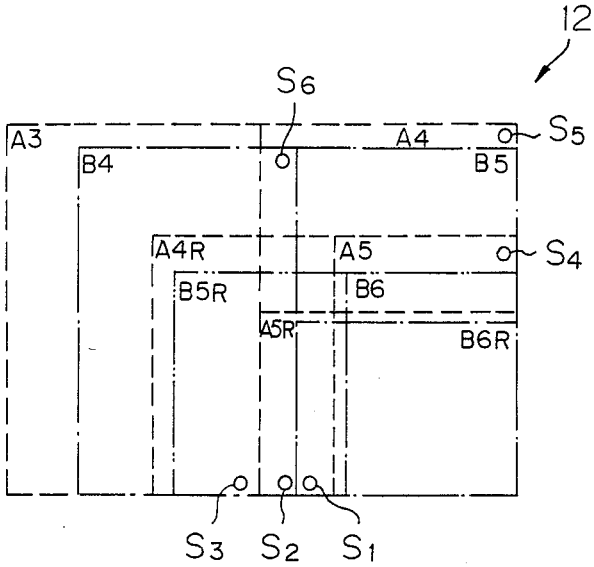
FIG. 2 is a schematic diagram showing an example of a document size detecting section shown in FIG. 1.

Referring to FIG. 2, a practical example of the document size detecting section 12 is shown and comprises six reflection type photosensors $S_1$–$S_6$. Each of the photosensors $S_1$–$S_6$ is mounted on that surface of the presser plate which is to contact a document. The CPU 10 discriminates a document size in response to outputs, generally $P_1$, of the photosensors $S_1$–$S_6$ and with reference to Table 1 shown below.

TABLE 1

| DOCUMENT SIZE (WITH ORIENTATION) | OUTPUT DATA FROM SENSORS $S_1$–$S_6$ | | | | | |
|---|---|---|---|---|---|---|
| | $S_1$ | $S_2$ | $S_3$ | $S_4$ | $S_5$ | $S_6$ |
| A3 | 1 | 1 | 1 | 1 | 1 | 1 |
| B4 | 1 | 1 | 1 | 1 | 0 | 1 |
| A4 | 1 | 1 | 0 | 1 | 1 | 1 |
| B5 | 1 | 1 | 0 | 1 | 0 | 0 |
| A5 | 0 | 0 | 0 | 1 | 0 | 0 |

TABLE 1-continued

| DOCUMENT SIZE (WITH ORIENTATION) | OUTPUT DATA FROM SENSORS $S_1$-$S_6$ | | | | | |
|---|---|---|---|---|---|---|
| | $S_1$ | $S_2$ | $S_3$ | $S_4$ | $S_5$ | $S_6$ |
| B6 | 0 | 0 | 0 | 0 | 0 | 0 |
| A4R | 1 | 1 | 1 | 1 | 0 | 0 |
| B5R | 1 | 1 | 1 | 0 | 0 | 0 |
| A5R | 1 | 1 | 0 | 0 | 0 | 0 |
| B6R | 1 | 0 | 0 | 0 | 0 | 0 |

In Table 1, the sheet sizes correspond to those shown in FIG. 2 and each size with suffix "R" represents that a document is placed vertically long.

Figure 3:
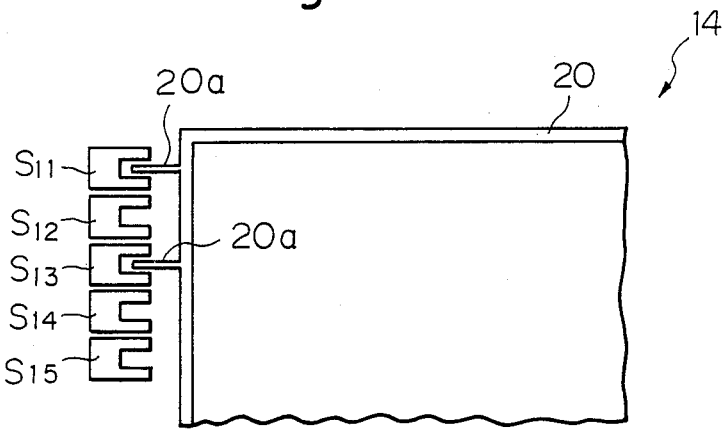
FIG. 3 is a fragmentary view of a sheet size detecting section shown in FIG. 1.

FIG. 3 shows a practical example of the sheet size detecting section 14. As shown, the section 14 comprises five photointerrupters $S_{11}$–$S_{15}$ which are arranged side by side in a position inside a housing of the copier (not shown) where a sheet cassette 20 will be mounted. Meanwhile, the sheet cassette 20 has lugs 20*a* at one end thereof. Particular size and orientation of sheets stacked in the sheet cassette 20 are represented by positions and combination of such lugs 20*a*. When the sheet cassette 20 is placed in the copier, light in those photointerrupters corresponding in position to the lugs 20*a* are intercepted thereby. Thus, the CPU 10 identifies a sheet size based on outputs, generally $P_2$, of the photointerrupters $S_{11}$–$S_{15}$ which have one-to-one correspondence with the sheet sizes.

Figure 4:
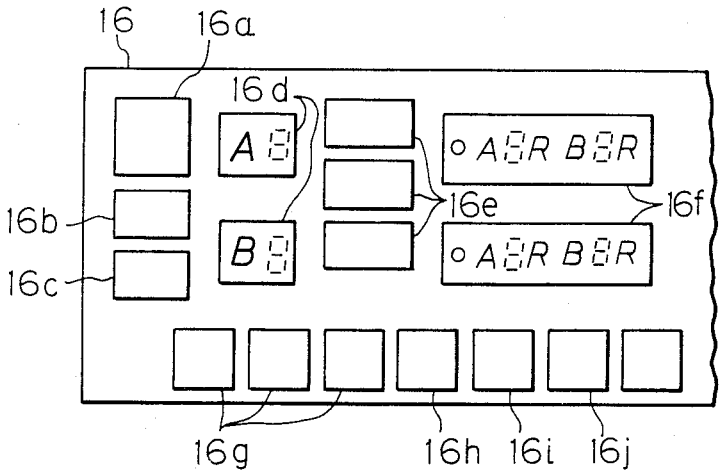
FIG. 4 is a fragmentary view of a display section shown in FIG. 1.

Referring to FIG. 4, an example of the display section 16 is shown. The display section 16 comprises a magnification display 16*a* responsive to a selected magnification, a size display 16*b* allowing an operator to confirm a selected sheet size, an orientation display 16*c* allowing the operator to confirm an orientation of a document, a document size display 16*d* for displaying a document size, a mode display 16*e* for displaying various modes of operation, and a sheet size display 16*f* for displaying a sheet size. The display section 16 also comprises magnification keys 16*g* for selecting a desired magnification, a mode selection key 16*h*, a sheet size selection key 16*i* for selecting a sheet cassette, and a uniform size key 16*j* for selecting a uniform size mode of operation.

Figure 5:
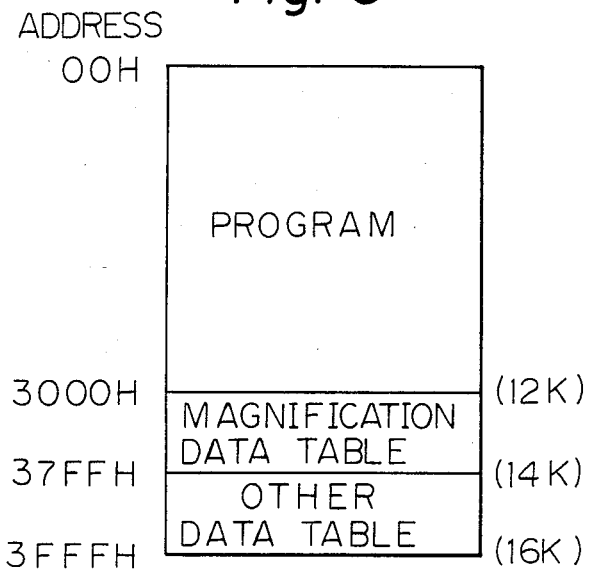
FIG. 5 is a memory map of a read only memory included in a central processing unit shown in FIG. 1.

FIG. 5 is a format indicative of data stored in the ROM 10*a*. Having a capacity of 16K bytes, the ROM 10*a* stores programs for the whole copier in 12K bytes of addresses 00H–300H (H indicating "hexadecimal"), a magnification data table for magnification data and like data in 2K bytes of addresses 3000H–37FFH, and other data tables in 2K bytes of 37FFH–3FFFH.

Part of the magnification data table is shown in Table 2. The ROM 10*a* stores 8-bit magnification data for a sheet size of A3 in its area consisting of the addresses 3000H–300FH, and 8-bit magnification data for a sheet size of B4 in an area consisting of the addresses 3010H–301FH. In Table 2, the lower four bits of each 8-bit magnification data represent magnification data corresponding to a specific magnification. Where the optics control section 18 is capable of setting magnifications which allow the whole picture on a document to be accommodated in a sheet when sheet sizes and document sizes indicated in the remarks of Table 2 are combined, i.e., magnifications theoretically provided by combinations of sheet sizes and document sizes, the magnification data are such magnifications; where it is incapable of doing so, the magnification data are, among magnifications which the optics control section 18 can set up, those which are closest to theoretical values and small.

The seventh bit (column of "6") is a vertical/horizontal check flag which becomes logical "1" when the orientation of a document and that of a sheet do not coincide with each other. The uppermost bit (column of "7") is a proper magnification check flag which becomes logical "1" when the document is excessively large or small for a sheet. The fifth and sixth bits are not used as data and store zeros, for example.

TABLE 2

| ADDRESS (HEXA-DECIMAL) | MAGNIFICATION DATA | | | | | | | | REMARKS | | |
|---|---|---|---|---|---|---|---|---|---|---|---|
| | 7 | 6 | 5 | 4 | 3 | 2 | 1 | 0 | SHEET SIZE | DOCUMENT SIZE | MAGNIFICATION |
| 3000 | 0 | 0 | | | 1 | 0 | 0 | 0 | A3 | A3 | ×1.0 |
| 01 | 0 | 0 | | | 1 | 0 | 0 | 1 | | B4 | 1.154 |
| 02 | 0 | 1 | | | 1 | 0 | 0 | 0 | | A4 | 1.0 |
| 03 | 0 | 1 | | | 1 | 0 | 0 | 1 | | B5 | 1.154 |
| 04 | 0 | 1 | | | 1 | 0 | 1 | 1 | | A5 | 1.414 |
| 05 | 0 | 1 | | | 1 | 0 | 1 | 1 | | B6 | 1.414 |
| 06 | 0 | 0 | | | 1 | 0 | 1 | 1 | | A4R | 1.414 |
| 07 | 1 | 0 | | | 1 | 0 | 1 | 1 | | B5R | 1.414 |
| 08 | 1 | 0 | | | 1 | 0 | 1 | 1 | | A5R | 1.414 |
| 09 | 1 | 0 | | | 1 | 0 | 1 | 1 | A3 | B6R | 1.414 |
| 0A | | | | | | | | | unused | | |
| 0B | | | | | | | | | | | |
| 0C | | | | | | | | | | | |
| 0D | | | | | | | | | | | |
| 0E | | | | | | | | | | | |
| 0F | | | | | | | | | | | |
| 3010 | (proper magnification check flag) | (vertical/horizontal check flag) | | | (magnification data) | | | | B4 | A3 | 0.865 |
| 11 | | | | | | | | | | B4 | 1.0 |
| 12 | | | | | | | | | | A4 | 0.865 |
| 13 | | | | | | | | | | B5 | 1.0 |
| 14 | | | | | | | | | | A5 | 1.224 |
| 15 | | | | | | | | | | B6 | 1.414 |
| 16 | | | | | | | | | | A4R | 1.224 |
| 17 | | | | | | | | | | B5R | 1.414 |
| 18 | | | | | | | | | | A5R | 1.414 |
| 19 | | | | | | | | | B4 | B6R | 1.414 |
| 1A | | | | | | | | | unused | | |
| 1B | | | | | | | | | | | |
| 1C | | | | | | | | | | | |
| 1D | | | | | | | | | | | |
| 1E | | | | | | | | | | | |

TABLE 2-continued

| ADDRESS (HEXA-DECIMAL) | MAGNIFICATION DATA 7 | 6 | 5 | 4 | 3 | 2 | 1 | 0 | REMARKS SHEET SIZE | DOCUMENT SIZE | MAGNIFICATION |
|---|---|---|---|---|---|---|---|---|---|---|---|
| 1F | | | | | | | | | | | |

Concerning a magnification data table for the other sheet sizes, as shown in Table 3, data relating to a sheet size of A4 are stored in the address 3020H–302FH of the ROM 10*a*, data relating to a sheet size of B5 in the addresses 3030H–303FH, data relating to a sheet size of A4R (vertically long A4) in the addresses 3040H–304FH, data relating to a sheet size of B5R (vertically long B5) in the addresses 3050–305FH, and data relating to a sheet size of A5R (vertically long A5) in the addresses 3060–306FH.

TABLE 3

| ADDRESS (HEXA-DECIMAL) | MAGNIFICATION DATA 7 | 6 | 5 | 4 | 3 | 2 | 1 | 0 | REMARKS SHEET SIZE |
|---|---|---|---|---|---|---|---|---|---|
| 3020 ~ 2F | | | | | | (magnification data) | | | A4 |
| 3030 ~ 3F | | | | | | (magnification data) | | | B5 |
| 3040 ~ 4F | | | | | | (magnification data) | | | A4R |
| 3050 ~ 5F | | | | | | (magnification data) | | | B4R |
| 3060 ~ 6F | | | | | | (magnification data) | | | A5R |

Figure 6A:
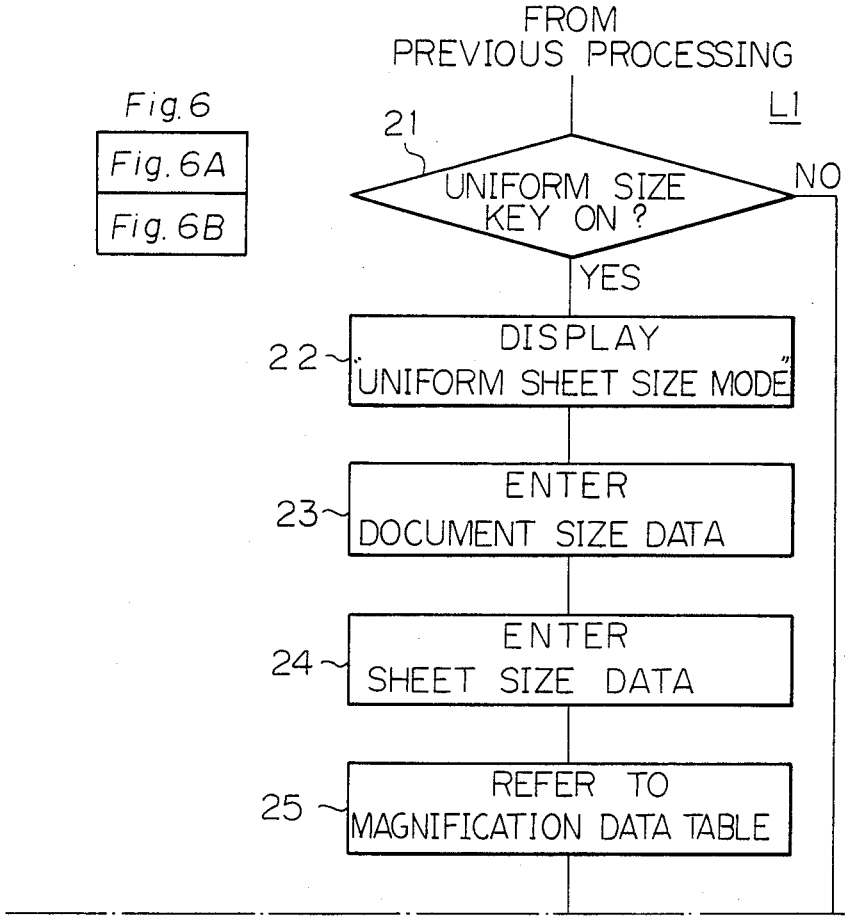
FIGS. 6A and 6B are combined to constitute a flowchart representing an example of a uniform sheet size mode routine.
Figure 6B:
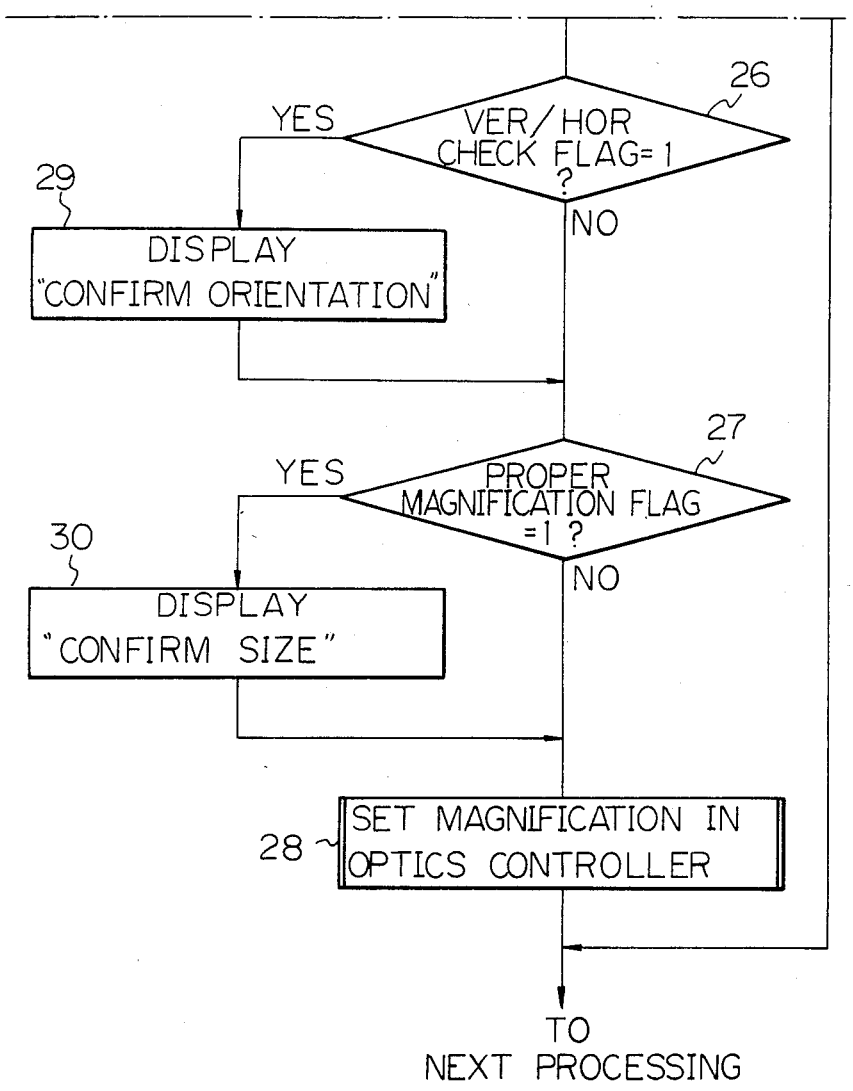

In the construction shown and described, as the operator depresses the uniform size mode key 16*j* in order to produce copy sheets by the uniform sheet size mode of operation, the CPU 10 performs, among the controls assigned thereto, a decision 21 of a uniform mode routine L1 shown in FIG. 6. Based on the result "YES" of the decision 21, the CPU 10 performs a processing 22 to display a sign "UNIFORM SHEET SIZE MODE" on the mode display 16*e*.

Then, the CPU 10 enters data output from the document size detector 12 as document size data (processing 23) while entering data output from the sheet size detector 14 as sheet size data (processing 24). In response to the results of the processings 23 and 24, the CPU 10 refers to the magnification data table to read relevant magnification data out of the ROM 10*a* (processing 25).

Assuming that the document size is B4 and the sheet size is A3, for example, the CPU 10 designates the address 3001H of the ROM 10*a* to read out data therefrom (see Table 2). In this case, the magnification data is $(00001001)_2$ in which the seventh bit or vertical/horizontal check flag is logical "0" and the eighth bit or proper magnification flag is logical "0". This makes the result of a decision 26 "NO" and that of a decision 27 "NO" so that the CPU 10 delivers magnification data $(1001)_2$ to the optics controller 18 to set up a magnification of $\times 1.154$ (processing 28).

Thereafter, the CPU 10 advances to the next processing (e.g. start processing for an optical system, or optics, ignition processing for various electrodes, etc.). Assuming that the document size is A4 and the sheet size is A3, the CPU 10 designates the address 3002H of the ROM 10*a* to read data therefrom. This time, the magnification data is $(1000101)_2$ in which the eighth bit or proper magnification check flag is logical "1", whereby the result of the decision 27 is "YES". The CPU 10, therefore, performs a processing 30 to display a predetermined message "CONFIRM SHEET SIZE" on the size display 16*b*, calling the operator's attention.

It will be noted that messages to appear on the size display 16*b* and orientation display 16*c* are not essential and may be replaced by energization of light emitting diodes (LED). In such a case, it is required to provide indications such as "CONFIRM ORIENTATION" and "CONFIRM SIZE" on the display surface of the display section 4.

Figure 7A:
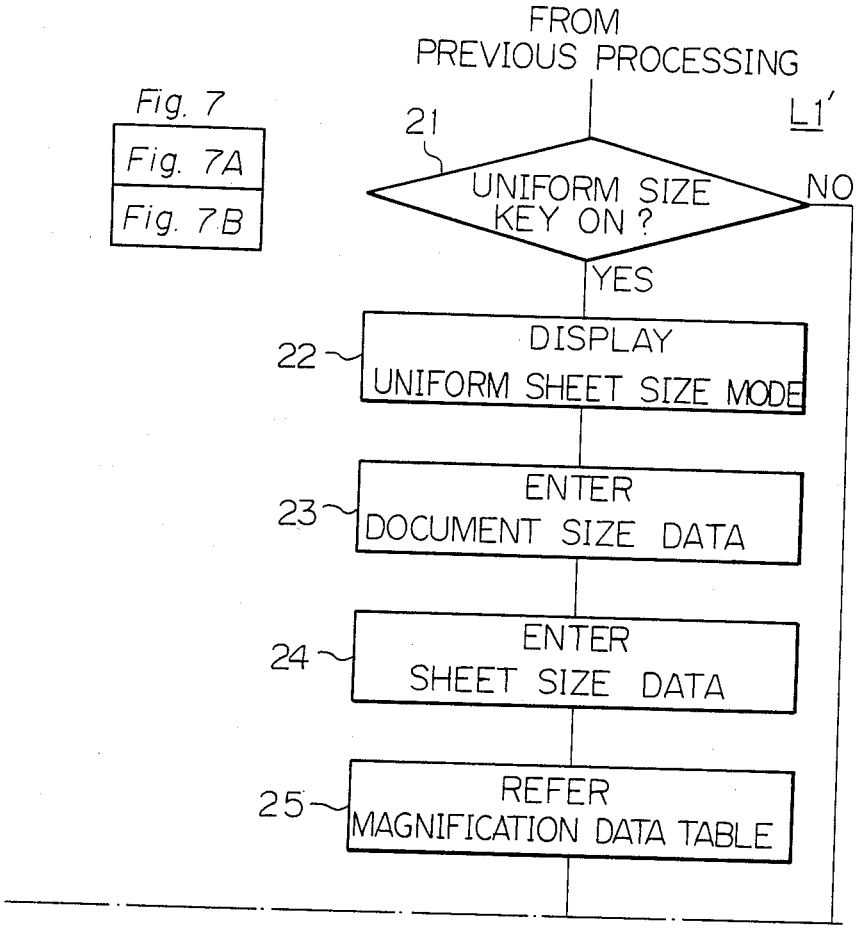
FIGS. 7A and 7B are combined to constitute a flowchart showing another example of the uniform sheet size mode routine.
Figure 7B:
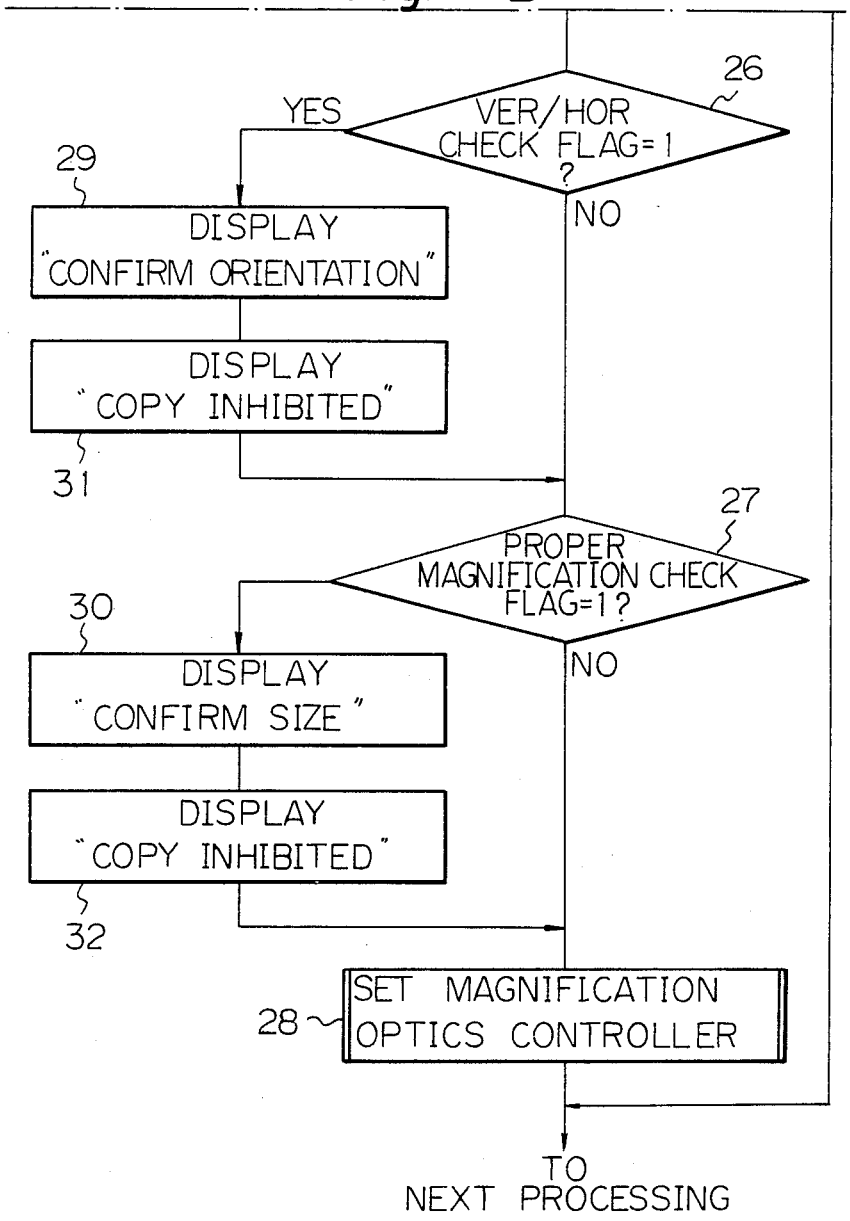

As shown in FIG. 7, when the results of the decisions 26 and 27 are commonly "YES", the CPU 10 performs the processings 29 and 30 to call the operator's attention and then the processings 31 and 32 respectively. As a result, a message "COPY INHIBITED" is displayed to prevent the operator from operating the copier with an excessively large or small magnification.

Naturally, the CPU 10 performs a copy control in an ordinary copy mode of operation and the display section 16 additionally includes a print key, ten keys, a clear key and other keys, and a numeral display and other displays, which are furnished with in prior art copiers. It should be noted that the document size detecting section and sheet size detecting section shown and described are only illustrative and may be replaced with ones which have heretofore been employed.

In the illustrative embodiment, among the 2K bytes of store area of the ROM 10*a*, only 112 bytes from the address 3000H to the address 306FH are used to store the magnification data table. Where the copier is capable of operating with sheet sizes other than those shown and described, magnification data concerned with such sheet sizes may be stored in the address 3070H and onward.

In summary, it will be seen that the present invention provides a copier having a uniform sheet size mode which eliminates excessively large or small copies when operated in a uniform sheet size mode of operation. Because the ROM stores flag data indicative of whether the magnification is adequate and whether the orientation is adequate as well as the magnification data, it is needless to compare magnification data read out of the ROM with reference data, resulting in a simplified processing program.

Various modifications will become possible for those skilled in the art after receiving the teachings of the present disclosure without departing from the scope thereof.

What is claimed is:

1. A control device for a copier which is operable in a uniform sheet size mode to copy pictures on documents having different sizes in copy sheets having a predetermined single size by varying a magnification by means of a magnification mechanism of an optical system, said control device comprising:

copy sheet size detector means for detecting a size of copy sheets;

document size detector means for detecting a size of a document;

store means for storing magnification data which are optimum for various combinations of a size of a document, a size of copy sheets and an orientation of a document; and control means for causing the magnification mechanism to set a magnification and controlling a predetermined copying process in response to a copy sheet size detected by the copy sheet size detector means and a document size detected by the document size detector means;

the store means being constructed to store a proper magnification check flag indicative of whether the magnification is proper and a document orientation check flag indicative of whether an orientation of a document is proper.

2. A control device as claimed in claim 1, in which the copy sheet size detector means comprises a plurality of photocouplers, and lugs which are arranged on a sheet cassette for storing copy sheets of a predetermined size in a predetermined number and at a predetermined spacing.

3. A control device as claimed in claim 1, in which the document size detector means comprises a plurality of reflection type photosensors arranged in predetermined locations on a presser plate which presses a document against an optical scanning surface.

4. A control device as claimed in claim 1, in which the magnification data are predetermined to be values which allow at least a whole surface picture of a document to be fully accommodated in a copy sheet of the predetermined size.

5. A control device as claimed in claim 1, further comprising copy sheet display means for commanding confirmation of a size of a copy sheet in response to the proper magnification check flag read from the store means.

6. A control device as claimed in claim 1, further comprising document orientation display means for commanding confirmation of an orientation of a document in response to the proper document orientation check flag read from the store means.

7. A control device as claimed in claim 1, in which the store means comprises a read only memory.

* * * * *